United States Patent [19]

Williams

[11] Patent Number: 4,930,057

[45] Date of Patent: May 29, 1990

[54] SEARCHLIGHT DRIVE MEANS AND APPARATUS

[75] Inventor: Jack L. Williams, Orange, Calif.

[73] Assignee: ITT Corporation, New York, N.Y.

[21] Appl. No.: 351,700

[22] Filed: May 15, 1989

[51] Int. Cl.[5] ..... F21V 21/26

[52] U.S. Cl. ..... 362/272; 362/286; 362/386; 74/89.18; 74/435; 74/665 C

[58] Field of Search ..... 362/271, 272, 286, 386, 362/419, 428; 74/435, 89.18, 665 C; 343/765

[56] References Cited

U.S. PATENT DOCUMENTS

| | | | |
|---|---|---|---|
| Re. 29,266 | 6/1977 | Hessemer et al. | 362/386 |
| 1,611,267 | 12/1926 | Case | 362/386 |
| 2,757,547 | 8/1956 | Julin | 74/435 |
| 2,812,424 | 11/1957 | Heugel | 362/286 |
| 2,976,471 | 3/1961 | Harris | 74/435 |
| 3,233,475 | 2/1966 | Barber | 74/89.18 |

*Primary Examiner*—Carroll B. Dority
*Attorney, Agent, or Firm*—Menotti J. Lombardi

[57] ABSTRACT

Apparatus is described for a searchlight in which a lamp is mounted in a housing for both vertical and horizontal movement. Vertical drive means which is mounted in the housing includes a gear having a tooth portion and a ramp portion to permit up and down movement of said lamp. The housing has an integrally formed ring gear with a tooth portion less than 360 degrees and a ramp portion. A horizontal drive means engages the ring gear and drives the lamp in a horizontal plane less than 360 degrees.

15 Claims, 3 Drawing Sheets

SEARCHLIGHT DRIVE MEANS AND APPARATUS

CROSS REFERENCE TO RELATED APPLICATION

This application is related to design application entitled "Searchlight", filed Apr. 4, 1989, Ser. No. 07/333,207, pending 1/8/90.

BACKGROUND OF THE INVENTION

This invention is related to reversible drive means and more particularly to searchlight drive means and apparatus.

An example of a motor controlled lamp is known from U.S. Pat. RE No. 29,266, reissued Jun. 14, 1977. In this patent there is described an electric controlled lamp capable of being controlled from a remote location utilizing a pair of reversible electrical motors which are mounted within the lamp housing. Friction clutch means are included between the gears and the associated components. The arrangement requires stop means relating to the vertical axis of adjustment. Although the arrangement as disclosed in this patent does not require conductor rings and brushes, it does require the use of friction clutch means and stop means to accomplish the adjustment of the lamp and limitation of movement in the vertical and horizontal directions.

According to the prior art, the problem of protecting the connecting cables to the lamp and motor drives is normally accomplished by stop limits or other clutch means to prevent the cabling from being damaged as the motor is driven beyond the limits of the cabling configuration.

SUMMARY OF THE INVENTION

An object of the invention is to provide an improved searchlight drive means and apparatus.

According to the broader aspects of the invention, searchlight apparatus is disclosed in which a lamp is mounted in a lamp housing for vertical and horizontal movement; the vertical drive means is also mounted within the lamp housing for vertically driving the lamp. A base mounts the lamp housing and a horizontal drive means drives the lamp and lamp housing in a horizontal plane less than 360 degrees.

A feature of the invention is to provide a reversible drive in which a gear having less than 360 degrees of gear teeth and a ramp portion at the end of each said gear teeth, is engaged by a pinion which is selectively reversed so that the pinion drives the gear in one direction until the pinion reaches the ramp portion and continues to rotate in the one direction until it is reversed to move down the ramp portion and drive the gear in the other opposite direction.

BRIEF DESCRIPTION OF THE DRAWINGS

Other objects, features and advantages of the present invention will become more fully apparent from the following detailed description of the preferred embodiment, the appendant claims and the accompanying drawings in which:

DETAILED DESCRIPTION OF THE PREFERRED EMBODIMENT

Figure 1:
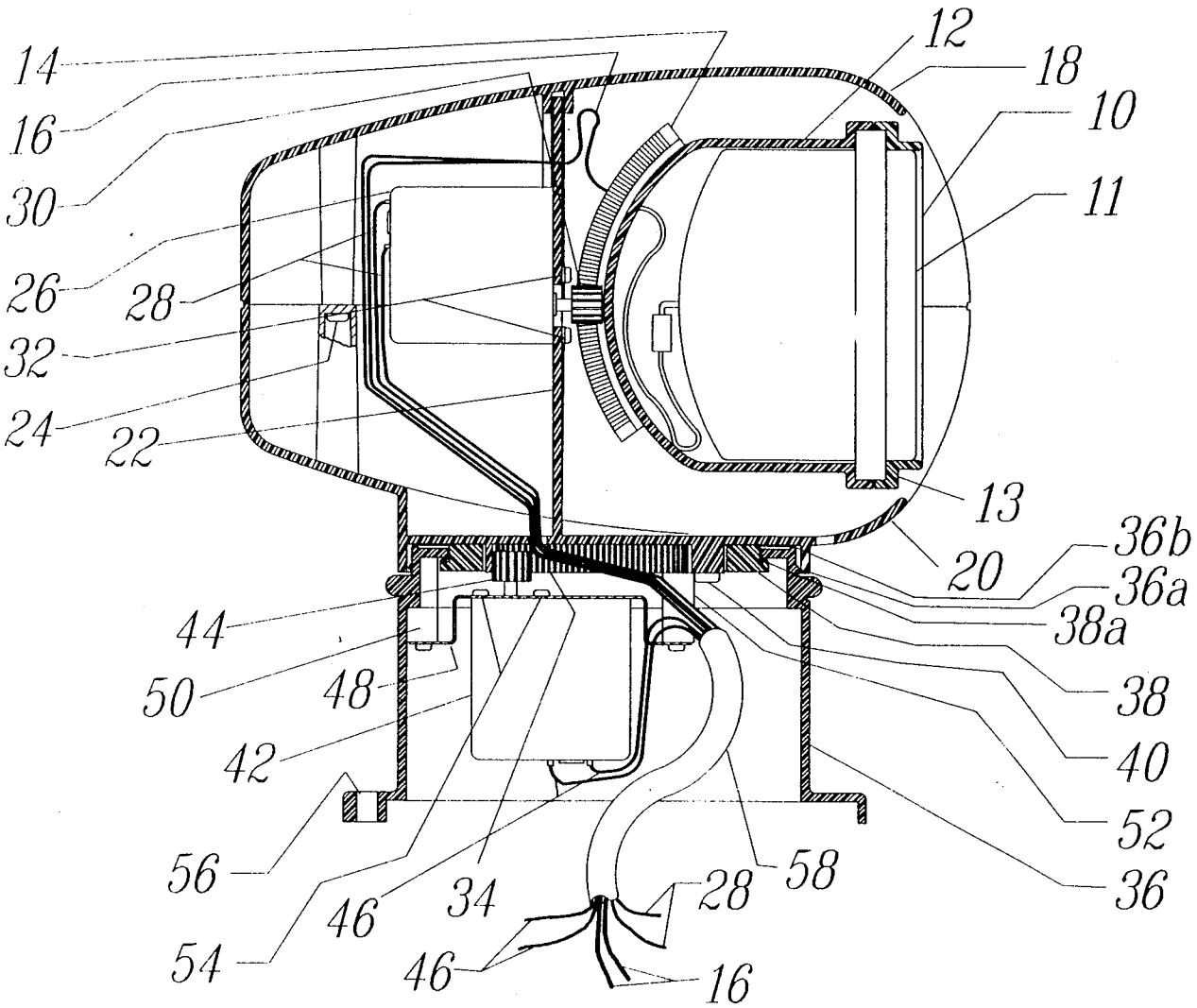
FIG. 1 is a partial cross sectional side view of the apparatus according to the invention.

Referring now to FIG. 1, there is shown a lamp 10 which includes a bulb 11, a bulb housing 12, and bulb retainer 13. The bulb housing 12 has an integrally formed vertical or up and down gear 14. The bulb 11 is connected by leads 16 to a 12-volt power source. The lamp is mounted in a lamp housing formed by an upper lamp housing 18 and a lower lamp housing 20. The lower housing 20 includes a bulkhead 22 which is integrally molded as part of the lower housing. The upper and lower lamp housing are mated in a complementary manner and retained together by screw means 24. The housing elements are molded from a plastic, preferably acrylic styrene acrylonitrile.

Mounted to the bulkhead 22 is a 12-volt DC reversible gear motor 26 having preferably a 32 rpm geared output. The motor is connected by leads 28 to a 12-volt power source and an arrangement whereby the plus and minus voltage on leads 28 of the DC motor may be reversed to reverse the output direction of the motor. Mounted on the output shaft of motor 26 is a pinion 30 which is preferably molded from powdered brass and secured to the output shaft of the motor. Motor 26 is mounted by screws 32 to the bulkhead which also provides the necessary flexure and pressure whereby the pinion maintains engagement with drive gear 14. The slack in leads 16 is sufficient to permit vertical or up and down movement of the lamp without damage or interference.

The lower housing has an internally formed ring gear 34 and is mounted to a base 36 by means of a retaining ring 38. Ring 38 retains the housing 20 to base 36 by means of screws, screw 40 is shown. A 12-volt DC reversible gear motor 42 which is mounted to the base 36 by spring means 48 also has a 32 rpm output. The output shaft of the motor 42 has mounted thereon a powdered brass molded pinion 44 which engages the ring gear 34 integrally molded as part of the lower housing 20. The motor 42 is connected by leads 46 to a source of 12-volt DC power and an arrangement wherein the plus and minus connections of the 12-volt supply may be reversed to control reversal of the motor. Screws 54 attach motor 42 to spring means 48 which is mounted by lugs 50, 52 to the base 36. Spring means 48 provides the necessary flexure and pressure so that the pinion 44 engages the teeth of the integrally formed ring gear 34.

Electrical cable 58 would be connected to a typical circuit and switch arrangement for connecting power to the filament of the bulb and for controlling the power to leads of the vertical and horizontal motors. Such a typical circuit and switch arrangement is shown in FIG. 10 of the referenced U.S. Pat. Re No. 29,266.

The base 32 with hole 56 shown includes holes for mounting the base by means of screws to a supporting surface for the lamp such as a car, fender, deck or bridge of a boat, a roof, or any other supporting surface. Similar to the housing elements, the base and retaining ring are molded from a plastic, preferably acrylic styrene acrylonitrile.

Figure 2:
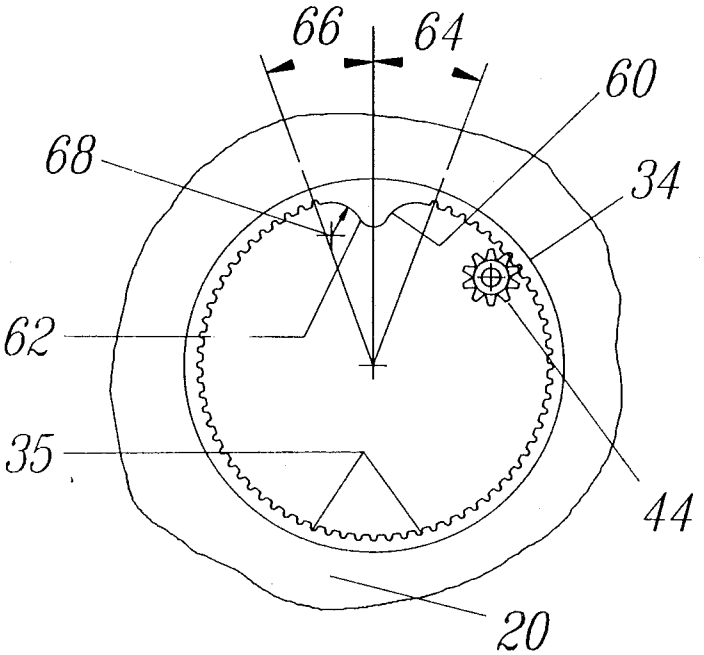
FIG. 2 shows the horizontal drive means according to the invention.

Referring now to FIG. 2, the internally formed ring gear 34 is shown as part of the lower lamp housing 20. The pinion 44 engages the teeth 35 which are less than 360 degrees of the ring gear and as shown may drive the gear until the gear reaches the ramp portion 60 or 62. Ramp 60 has in a preferred embodiment an arc 64 of approximately 17.5 degrees, and similarly, ramp 62 has an arc 66 of approximately 17.5 degrees. The ramp radius 68 is preferably slightly larger, i.e. 10–12%, than the pinion radius. For example, with a ramp radius of approximately 0.22 inches, the pinion radius would be approximately 0.19 inches. Driving pinion 44 is held in contact with the ring gear by the pressure exerted by the spring mounted motor 42 which resiliently retains the motor pinion 44 against the ring gear 34. When gear 44 comes to the end of its travel in either direction toward ramp 60, 62, the pinion 44 overcomes the resilient spring force and rides up out of engagement with the ring gear teeth 35 and the pinion 44 spins and stays on the ramp surface. This spinning of the pinion on the ramp prevents over travel and damage to the gear teeth and leads. When the pinion drive is reversed according to switching the polarity on the motor leads, the combination of the resilient spring tension and friction reengages the pinion and gear teeth 35 and the ring gear is driven in the opposite direction.

Figure 3:
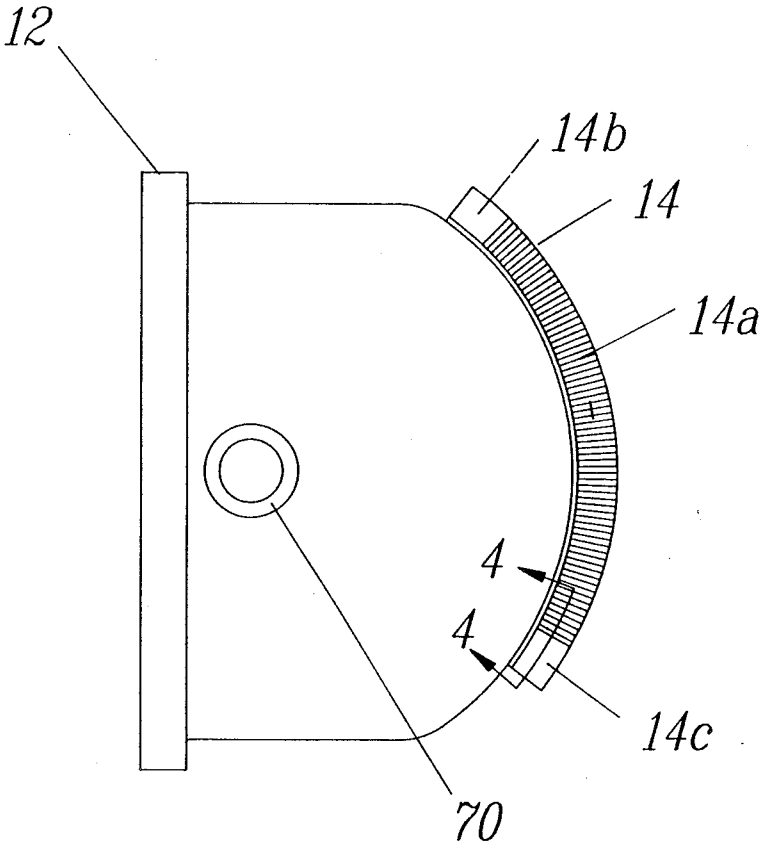
FIG. 3 shows the bulb housing with the integral vertical gear for the vertical drive means according to the invention.
Figure 4:
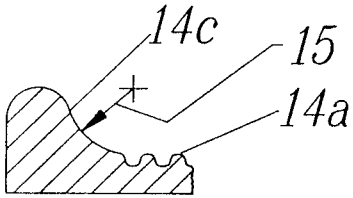
FIG. 4 is a sectional view taken along lines 4—4 of FIG. 3.

Referring now to FIG. 3, the bulb housing 12 has an integrally formed bearing member 70 and integrally formed vertical or up and down gear 14. Gear 14 has a gear teeth portion 14A and a ramp portion 14B and 14C at each end of the gear teeth section 14A. As shown in FIG. 4, taken along section 4—4 of FIG. 3, the ramp portion 14C rises up from gear tooth portion 14A. The radius 15 of ramp 14C is slightly larger, i.e. 10–12%, than the radius of pinion 30 which engages gear 14A. For example, with a ramp radius of 0.22 inches, the pinion radius would be approximately 0.19 inches. As described in connection with FIG. 2, the pinion 30 is held in contact with gear 14 by means of the resilient pressure provided by bulkhead 22 in the mounting of gear motor 24. When the pinion 30 comes to the end of travel in either the up or down direction, the pinion rides up out of engagement with gear teeth 14A and spins on ramp 14B or 14C. This prevents over travel and damage to the gear teeth and leads. When the pinion 30 is reversed, the combination of the pressure provided by the bulkhead mounting of motor 24 and the friction between pinion 30 and the surface of the ramp 14B or 14C, the pinion reengages the gear teeth and the bulb housing is driven in the opposite direction.

Figure 5:
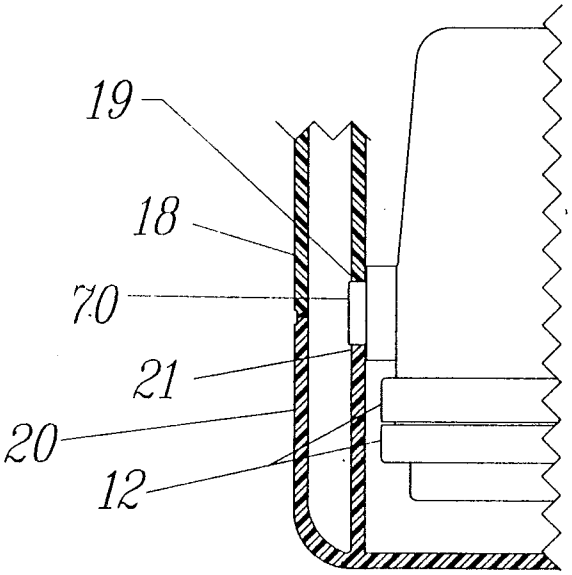
FIG. 5 is a partial section view showing the bearing of the bulb housing mounted in the lamp housing.

FIG. 5 is a partial cross sectional view showing bearing 70 mounted in bearings surfaces 21 and 19 integrally formed as part of lower and upper housings 20, 18 respectively. The bearing surfaces 19, 21 allow the bulb housing to slidably rotate in the vertical or up/down plane. Since the bulb housing 12 including the bearing 70 and the upper and lower lamp housing bearing surfaces 21, 19 are molded from plastic, the material provides a natural lubricating surface to allow free movement in the vertical plane. Referring also to FIG. 1, the base 36 includes circumferentially formed nipples, 36A and 36B, which provides the slidable bearing surface for lower housing 20 in the horizontal plane, and retaining ring 38 has a circumferentially formed nipple 38A which provides the slidable bearing surface between the retaining ring 38 and the base 36. Since all these parts are molded from a plastic material, the material provides a natural lubricating surface and allows free movement of the lamp in a horizontal plane.

As should be readily understood by one skilled in the art, I have described a searchlight drive means and apparatus in a preferred embodiment thereof, in which a lamp is mounted in the lamp housing for vertical and horizontal movement. The vertical drive means is mounted within the lamp housing for vertically driving the lamp in an up/down mode for a distance controlled by the up/down gear. The base rotatably mounts the lamp housing for rotation in a horizontal plane less than 360 degrees to prevent damage to the connecting leads. The horizontal drive means controls driving the lamp housing in horizontal plane. A reversible gear motor with its pinion engages the vertical gear member which includes a gear tooth section and a ramp section at each end of the gear section. The lamp housing also includes a lower housing with an integrally formed ring gear. The ring gear includes a gear portion having gear teeth less than 360 degrees and a ramp portion at each end of the gear teeth. A reversible gear motor having an output shaft with a pinion engages the ring gear and drives the gear in the horizontal plane. The power to the reversible DC gear motors is reversed in a known manner by means of a toggle or similar type switch arrangement so that the up/down or vertical movement of the lamp can be coordinated and controlled with the horizontal motion to focus the lamp in the desired direction. When the power is removed from the DC gear motors, the lamp will retain its last powered position. Although the lamp will retain its last powered position in the combination of vertical and horizontal planes, the lamp housing may be physically moved by hand against the drive either in the up/down or left/right without damage up to the ramp locations. However, movement by force beyond the ramp positions may cause damage to the assembly and twisting of the leads beyond the slack provided for less than the 360 degree horizontal motion, or the vertical motion.

While the present invention has been disclosed in connection with a preferred embodiment thereof, it should be clearly understood that there may be other embodiments which fall within the spirit and scope of the invention as defined by the following claims.

What is claimed is:

1. Searchlight apparatus comprising:

lamp means mounted in a lamp housing for vertical movement;

vertical drive means mounted in said lamp housing for vertically driving said lamp;

base means for mounting said lamp housing;

horizontal drive means for driving said lamp means and lamp housing in a horizontal plane less than 360 degrees; and said lamp means including a bulb housing with a bearing means for mounting in said lamp housing, and said bulb housing including an integrally formed vertical gear member.

2. The apparatus of claim 1 including a reversible gear motor having an output shaft with pinion means for engaging said vertical gear member.

3. The apparatus of claim 2 wherein said vertical gear member includes a gear tooth portion and a ramp portion at each end of said gear tooth portion.

4. Searchlight apparatus comprising:

lamp means mounted in a lamp housing for vertical movement;

vertical drive means mounted in said lamp housing for vertically driving said lamp;

base means for mounting said lamp housing;

horizontal drive means for driving said lamp means and lamp housing in a horizontal plane less than 360 degrees; and said lamp housing includes a lower housing with an integrally formed ring gear.

5. The apparatus of claim 4 wherein said ring gear includes a gear tooth portion less than 360 degrees and a ramp portion at each end of said gear tooth portion.

6. The apparatus of claim 5 including a reversible gear motor having an output shaft with a pinion means for engaging said ring gear.

7. The apparatus according to claim 6 including spring means for mounting said motor to said base means.

8. The apparatus according to claim 4 wherein said lower housing includes an integrally molded bulkhead for mounting said reversible gear motor.

9. Apparatus for a searchlight comprising:

lamp means having an up and down gear is mounted in a housing for up and down movement and said housing mounted on a base for left and right movement;

up and down drive means mounted in said housing, said drive means engaging said up and down gear, and said up and down gear having a tooth portion and an inclined ramp portion at each end of said tooth portion;

said housing including a ring gear having a tooth portion less than 360 degrees; and left and right drive means mounted in said base to engage said ring gear and drive said lamp means in a left and right direction.

10. A reversible drive comprising:

a ring gear having gear teeth less than 360 degrees and a ramp portion at each end of said gear teeth; and a reversible pinion drive and pinion for selectively driving said ring gear in a first and second direction, said pinion engaging said gear teeth and driving said ring gear in said first direction until said pinion reaches said ramp portion, whereupon said pinion will continue to rotate on said ramp portion until said pinion drive is reversed and said pinion moves down said ramp to engage said teeth and drive said gear in said second direction.

11. The drive of claim 10 wherein said ramp has a radius which is slightly larger than the radius of said pinion.

12. In combination, a reversible drive comprising:

a gear having less than 360 degrees of gear teeth and a ramp portion rising upward from the end of said gear teeth; and means including a pinion engaging said teeth and selectively reversible, whereby said pinion drives said gear in one direction until said pinion reaches said ramp portion, rides up out of engagement with said teeth and continues to rotate on said ramp portion in said one direction until said pinion is reversed to move down said ramp portion and to engage said teeth drive said gear in the other opposite direction.

13. The combination of claim 12 wherein the radius of said ramp is slightly larger than radius of said pinion.

14. The combination of claim 13 wherein said gear is molded from plastic.

15. The combination of claim 14 wherein said pinion is molded from powdered brass.

* * * * *